United States Patent [19]

Scolari et al.

[11] Patent Number: 4,678,450

[45] Date of Patent: Jul. 7, 1987

[54] TOY LIGHT SWORD

[75] Inventors: John E. Scolari, La Mesa; Robert T. Warner, Poway; Joe E. Deavenport, San Diego, all of Calif.

[73] Assignee: Life Light Systems, San Diego, Calif.

[21] Appl. No.: 618,316

[22] Filed: Jun. 7, 1984

Related U.S. Application Data

[63] Continuation-in-part of Ser. No. 453,355, Dec. 27, 1982, abandoned.

[51] Int. Cl.[4] ..... A63H 5/00; A63H 33/26

[52] U.S. Cl. ..... 446/405; 446/473; 446/485; 362/102; 362/202; 340/321; 315/241 P

[58] Field of Search ..... 446/485, 484, 473, 397, 446/405, 406, 407; 362/202, 102, 84; 315/241 P; 354/145.1; 340/321

[56] References Cited

U.S. PATENT DOCUMENTS

| | | | |
|---|---|---|---|
| 2,694,138 | 11/1954 | Schwinn | 362/102 |
| 2,713,629 | 7/1955 | Etzkorn | 362/84 |
| 2,959,892 | 11/1960 | Johnson | 446/485 X |
| 3,201,898 | 8/1965 | Lahr et al. | 446/442 |
| 3,531,892 | 10/1970 | Pearce | 46/228 |
| 3,610,916 | 10/1971 | Meehan | 446/485 X |
| 3,707,055 | 12/1972 | Pearce | 446/485 |
| 4,175,353 | 11/1979 | Pickett | 446/406 |
| 4,208,701 | 6/1980 | Schock | 446/485 X |
| 4,209,823 | 6/1980 | Burkdoll | 362/84 |
| 4,236,348 | 12/1980 | Dulac | 446/485 |
| 4,282,681 | 8/1981 | McCaslin | 446/484 |
| 4,365,439 | 12/1982 | Litynski | 446/406 |

OTHER PUBLICATIONS

JLA, "The Hot Ones", The Force Beam, *Playthings*, Aug. 1978, p. 71.

*Primary Examiner*—Mickey Yu
*Attorney, Agent, or Firm*—Baker, Maxham & Jester

[57] ABSTRACT

A toy light sword including a hollow blade with a fluorescent coating on the inside, or it may be translucent and tend to glow when illuminated. A stroboscopic lamp unit is discharged by a switch to provide a burst of high intensity light and a glow on the sword blade. An inertial switch is provided in the blade in one optional embodiment whereby the high-intensity light is discharged when the sword is moved against an object to indicate that contact has been made. Also, a sound generator can be provided to emit a sound when the burst of light occurs. An exemplary circuit for use with the light sword is also part of the invention.

28 Claims, 10 Drawing Figures

TOY LIGHT SWORD

CROSS-REFERENCE TO RELATED APPLICATION

This is a Continuation-In-Part of application Ser. No. 453,355 filed Dec. 27, 1982, now abandoned.

BACKGROUND OF THE INVENTION

The present invention relates to a toy light sword and particularly to one that generates a flash of high-intensity light similar to a laser and the circuit for use therewith.

Toy swords are popular and a sword that emulates a laser is very desirable because of the popularity of spaceage technology, movies, and television programs. Also, there is no good way to indicate in a simulated sword duel that a person has made contact with the opponent. It is desired to have an indication that is readily visible so that those that are playing can decide when contact has been made. Such a toy sword is particularly appealing to the toy market.

Power supplies have been proposed for electronic flash purposes where the circuit, operating from a power source, functions with means for charging and discharging a capacitor for operating the flash lamp. Typically, many of the systems have had means of some type for sensing the capacitor voltage and disabling or turning off the charging circuit after the capacitor has been fully charged, to save power.

The prior art systems mentioned above generally have limitations which make them not suitable for use with toy weapons which require an immediate bright flash in response to trigger actuation, rapid recharging to afford as much realism as possible for children playing with such toys, and relative light weight. These prior systems typically have a relatively long charging time, between 6 and 30 seconds, or have relatively large sources of power, such as large or bulky batteries, or are connected to an AC source and are thereby non-portable. Also these systems, in order to achieve the desired results, are frequently quite complex as well as being too large to be employed in a children's toy. Another problem with many prior art systems is that the voltage sensing mechanism is not precise so there is a relatively large swing between full charge of the flash capacitor and the voltage level at which the charge again builds up. They often use a linear technology or a flyback transformer in the feedback circuit.

SUMMARY OF THE INVENTION

The desired characteristics of a toy light sword are accomplished by a preferred embodiment of the present invention wherein a high-intensity burst of light is generated along the blade of the sword. Further, inertial switch means can be actuated when the sword is moved sideways against an object to provide a bright impulse of high-intensity light on the blade.

The circuit of this invention comprises a controlled high voltage generator with a rapid charge rate operating at high efficiency while using a low voltage DC power source. The circuit employs an oscillator to drive a DC/AC inverter connected to a low voltage DC power supply, such as a battery, to switch the power supply on and off at the desired frequency. The inverter also boosts the voltage by a factor of 10 to 15 and then a rectifier and voltage multiplier convert the signal to a high level DC voltage which is applied to a storage capacitor. A feedback circuit senses the output of the voltage multiplier and applies that voltage to a Schmitt trigger comparator, the output of which controls the operation of the oscillator.

The efficiency and low power loss aspects of the circuit and its components help make this voltage generator particularly adaptable for small toys where a rapid recharging rate is necessary, and for portable emergency flash units.

BRIEF DESCRIPTION OF DRAWING

The objects, advantages and features of this invention will be better understood from the following detailed description when read in conjunction with the accompanying drawing, in which.

DESCRIPTION OF THE PREFERRED EMBODIMENT

Figure 2:
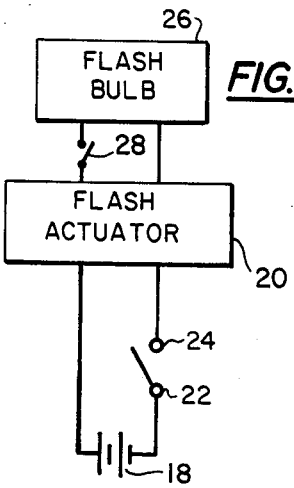
FIG. 2 is a basic block diagram of circuitry for generating the light burst.

The toy light sword of the present invention is shown at 10 in the drawing. The sword includes a blade 12 preferably coated with a fluorescent material 13 on the inside, a hand-protecting shield 14 and a hilt 16. The blade may also be semi-transparent or translucent and tend to glow when illuminated. The blade 12 is made of a transparent material such as a suitable non-brittle plastic. A battery 18 is disposed in the hilt and is connected to a strobe lamp actuating unit 20 enable contacts 22 and 24 switch (FIG. 2). Strobe lamp actuating unit 20 is connected to the strobe lamp 26 through switch 28 which is used to selectively energize the strobe lamp actuating unit 20 and fire the strobe flash lamp 26. A slide switch is shown and a push button or other type of hand actuating switch can be used. A simulated ruby 30 is positioned at the back end of the hilt 16. When the strobe flash lamp 26 is fired, light travels through the hollow hilt 16 and lights the simulated ruby 30. The burst of light from the strobe flash lamp 26 also lights the fluorescent coating 13 on the interior of the sword blade 12. The fluorescent coating retains a glow after the strobe flash lamp has been fired.

Figure 1:
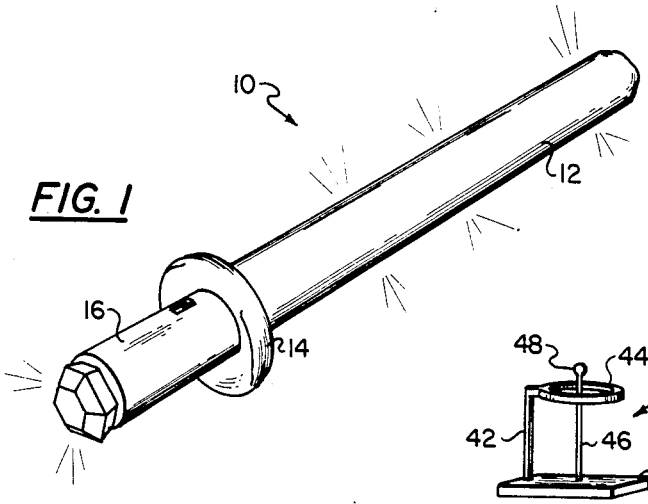
FIG. 1 is a perspective view of the first embodiment of the toy light sword of the present invention.
Figure 5:
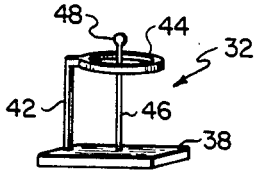
FIG. 5 is a perspective view of the inertial switch used with the second embodiment of the present invention.
Figure 6:
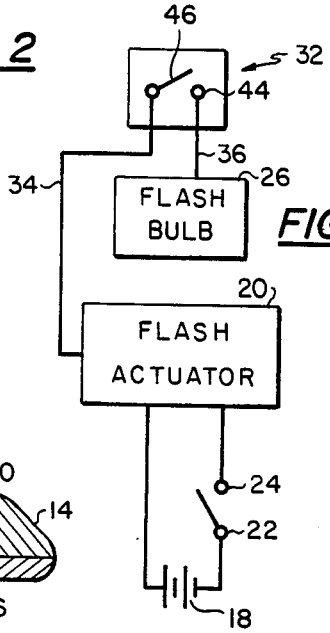
FIG. 6 is a block diagram similar to FIG. 2 showing the circuitry for generating a burst of high intensity light when the inertial switch is actuated.
Figure 4:
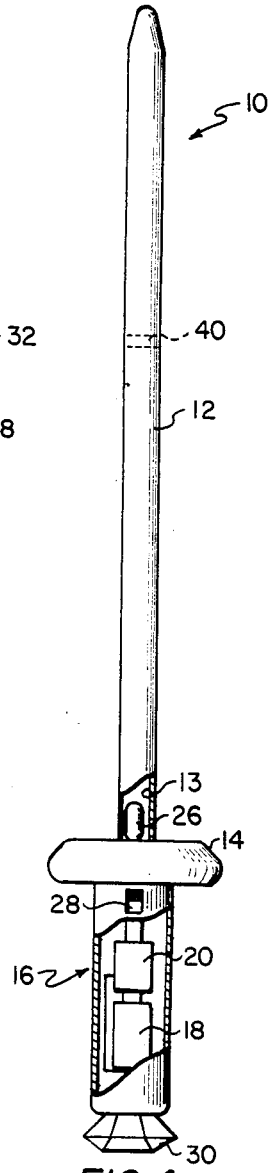
FIG. 4 is an elevational, partial sectional view of the toy light sword of FIG. 1.

A second embodiment of the present invention is demonstrated in FIGS. 5 and 6 of the drawing. In this embodiment of the invention, the strobe flash lamp actuating unit 20 is connected to an inertial switch 32 through wire 34 and the inertial switch 32 is connected through wire 36 to the strobe flash lamp 26. The inertial switch 32 includes the base of insulating material 38 mounted in the sword blade 12 at a position such as shown at 40 in dotted line in FIG. 4 of the drawing. Referring back to Figure 5, a support post 42 is mounted on the base 38 and includes contact ring 44. The support post and ring are electrically conductive and form one contact of the inertial switch 32. An upright wire 46 of relatively stiff material, such as piano wire, is mounted on the base 38 and connects with the strobe flash lamp 26. A mass such as a ball 48 is disposed on the end of the wire 46 so that the wire will move sideways when the sword is moved sideways.

With the switch 22 turned on, when the sword blade 12 is moved sideways and its movement is interrupted, the ball 48 carries the wire 46 into contact with contact ring 44. This closes the circuit shown in FIG. 6 and the strobe flash lamp 26 fires, causing the blade 12 to glow. This is an indication that contact has been made with the sword.

Figure 7:
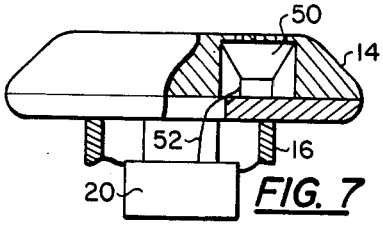
FIG. 7 is a partial view of the hand shield and hilt, partially sectioned to show the sound generator.
Figure 3:
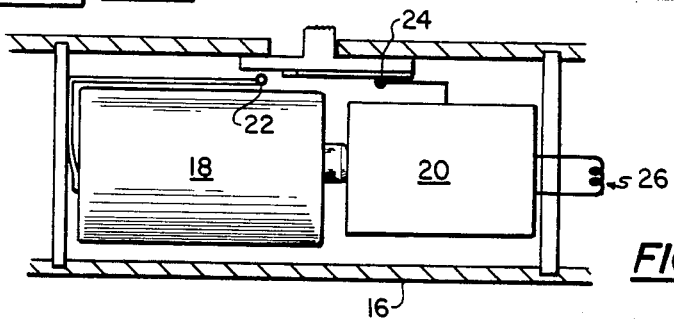
FIG. 3 is an enlarged view of a portion of the hilt of the sword sectioned to show internal construction.

A sound can be generated if desired when the flash lamp fires. FIG. 7 shows an embodiment wherein a sound generator 50 is positioned within the hollow shield 14 and is connected through electric lead 52 to the strobe lamp actuating unit 20. Thus, an audio signal as well as a visual signal is produced when the circuit is closed.

Figure 8:
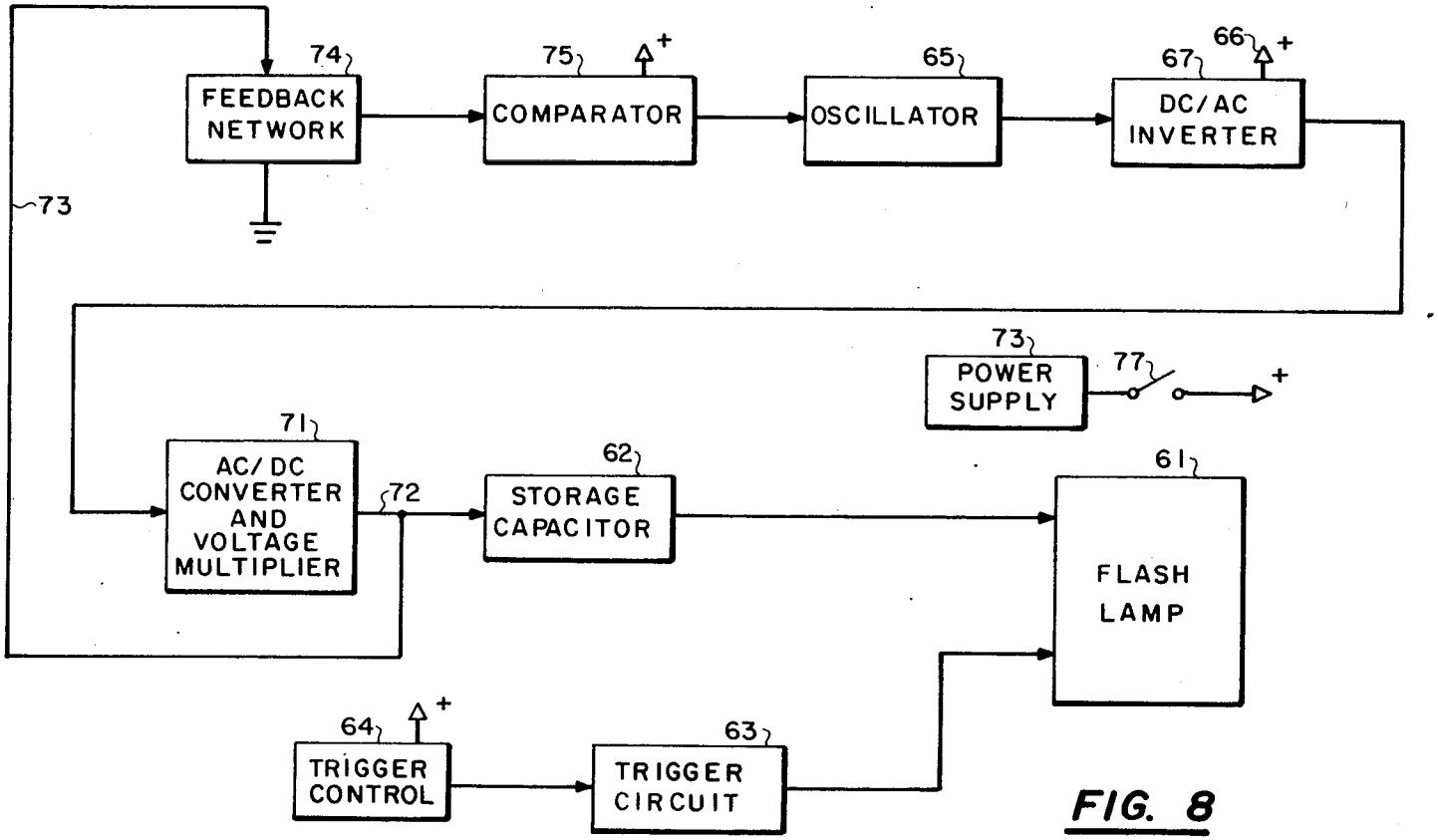
FIG. 8 is a more detailed block diagram of a controlled high voltage generator employed in the light sword of FIG. 1.
Figure 9:
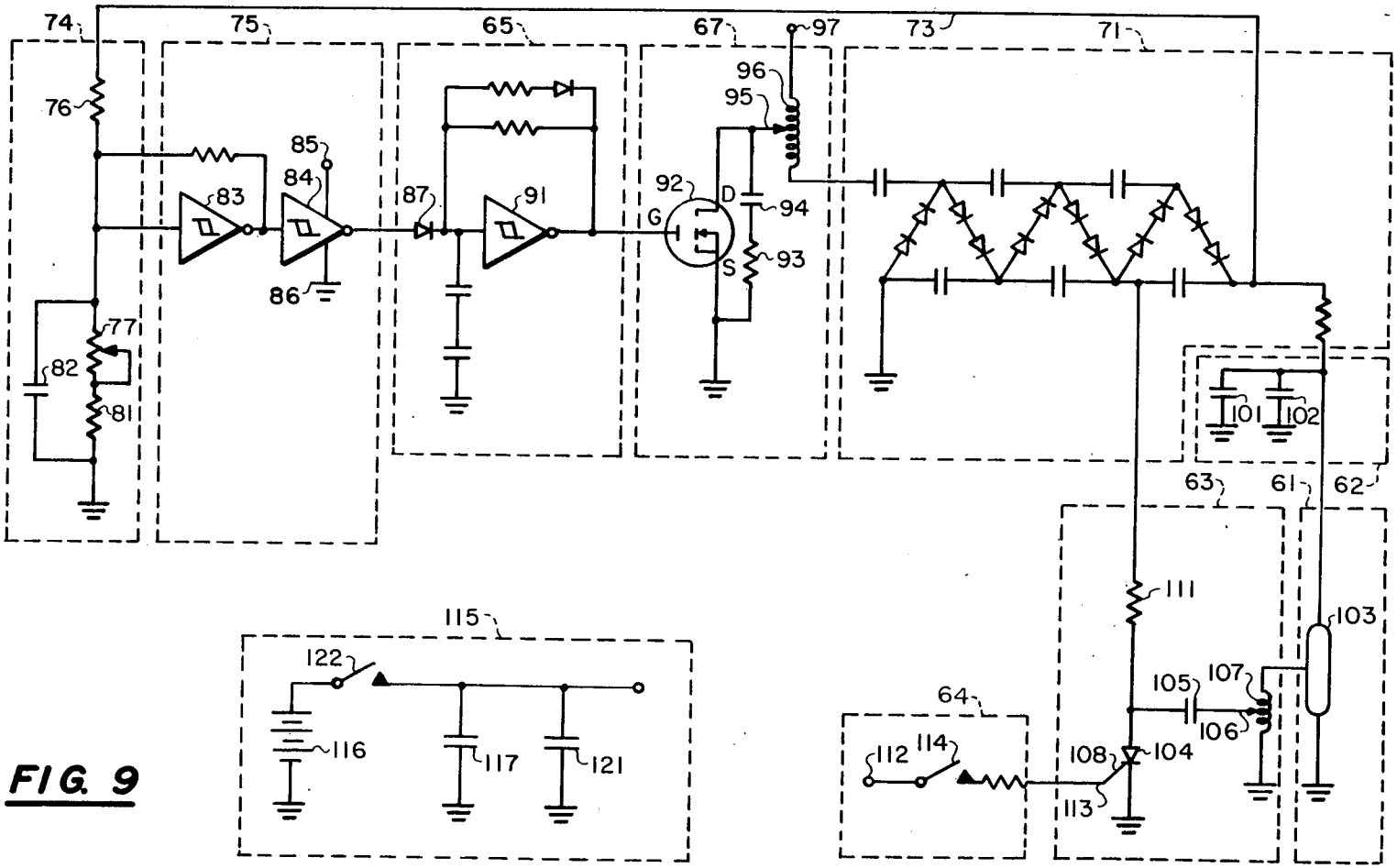
FIG. 9 is a generalized schematic diagram of the generator of FIG. 8.
Figure 10:
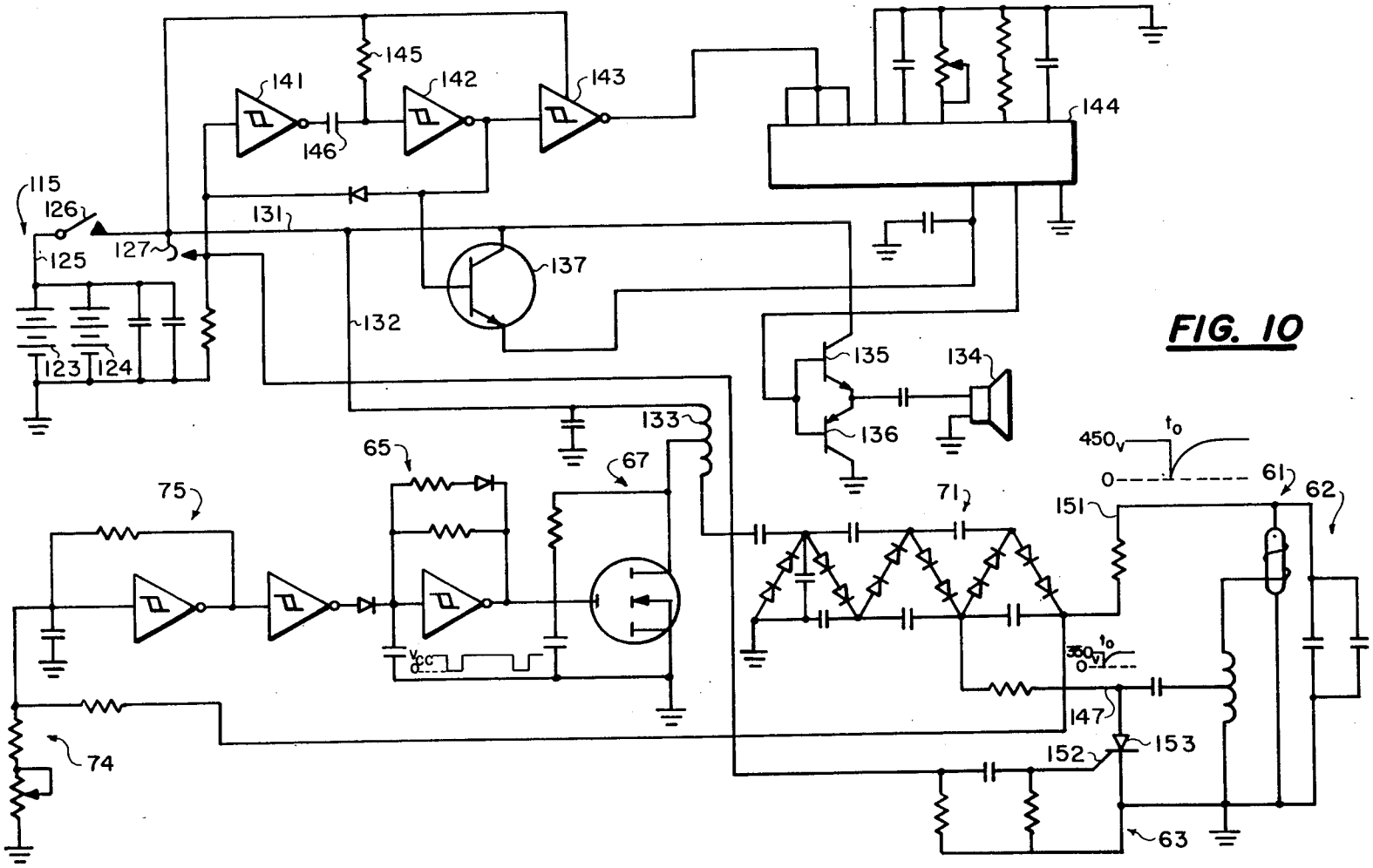
FIG. 10 is a specific schematic diagram of the generator of FIGS. 8 and 9 configured for use in a toy light sword.

The high voltage generator used to create the desired short duration, high-intensity flash is shown in FIGS. 8–10. FIG. 8 shows a generalized block diagram of the system for generating flashes. Flash lamp 61 has a high voltage, approximately 450 volts, applied to it from storage capacitor 62. The lamp flashes upon actuation by a signal from trigger circuit 63 which discharges the storage capacitor across the flash lamp causing a substantially instantaneous bright flash. The trigger circuit is actuated by a signal from trigger control 64 which essentially comprises a trigger switch.

A control signal is applied to the input of oscillator 65 which operates at an appropriate frequency, in the range of 20 to 200 KHz, preferably about 25 KHz. A low DC voltage is applied to terminal 66 of DC/AC inverter 67 and, in conjunction with the switching engendered by oscillator 65, the inverter has a substantially amplified AC voltage output, approximately 10 to 15 times its input voltage. The AC output is applied to AC/DC converter/multiplier 71 where the voltage is rectified and multiplied to approximately 450 volts at output 72. This voltage may range from 400 to 475 volts and is applied across storage capacitor 62 to fire the flash lamp when triggered. A feedback loop 73 couples the output of multiplier 71 with feedback network 74, the output of which is applied to comparator 75. When the voltage on storage capacitor 62 reaches the desired level, it is sensed by the feedback network and comparator, and the comparator switches to disable the oscillator. When the voltage on the storage capacitor has been reduced, at least by a predetermined value, either by leakage or by discharge, a lower voltage appearing in the feedback network causes the comparator to switch the oscillator to an oscillating condition and quickly recharge the storage capacitor.

The schematic diagram of FIG. 9 shows a basic example of the components in the blocks of FIG. 8. Feedback network 74 comprises a resistor 76 in series with a potentiometer 77 and another resistor 81. The potentiometer enables the level of voltage detected by the feedback network to be adjusted. Resistors 81 and potentiometer 77 are shunted by capacitor 82.

The feedback network is connected to comparator 75 comprised of Schmitt trigger elements 83 and 84. For convenience, element 84 is shown with a positive voltage input terminal 85 and a ground terminal 86. Actually, each such element in a single chip of many such elements would have the positive and ground terminals.The output of the comparator is fed to diode 87 in oscillator 65, which also comprises a Schmitt trigger element 91. Elements 83, 84 and 91 are part of a single CMOS chip 40106 which is available from a number of different sources. The other diode, resistors and capacitors comprising the oscillator are common elements, typically arranged, and need not be described in detail here.

The output of the oscillator is applied to the gate terminal of field effect transistor (FET) 92, the D and S terminals of which are coupled across a series RC network comprising resistor 93 and capacitor 94. The D terminal of the FET and the RC network are connected to the tap 95 of coil 96. DC voltage from the power supply is applied to one end of coil 96 through terminal 97.

The output of the DC/AC inverter 67 is connected to the input of AC/DC converter and voltage multiplier 71 which serves to rectify the medium level voltage AC signal out of the inverter and increase the voltage applied to storage capacitor 62 to approximately 450 volts. The storage capacitor is shown as being comprised of two capacitor elements 101 and 102 but this is a matter of design choice as to whether one or more capacitors are used. The charge stored in capacitor 62 is applied across tube 103 of flash lamp 61 and provides a bright flash when fired by means of trigger circuit 63 comprising silicon controlled rectifier (SCR) 104 connected through capacitor 105 to the tap 106 of coil 107. The capacitor is also connected through a resistor 111 back to AC/DC converter and voltage multiplier 71. When transistor (SCR) 104 conducts, the charge stored in storage capacitor 105 triggers flash lamp 103 into conduction through trigger coil 107 for an instantaneous brilliant flash.

Trigger circuit 63 is controlled by trigger control 64 comprising DC voltage input terminal 112 connected to lead 113 of transistor 104 through on/off or trigger switch 114.

Power supply 115, which powers the entire high voltage generator, comprises battery 116 shunted by capacitors 117 and 121 through normally closed enabling switch 122. Battery 116 may comprise more than one actual battery element, which would normally be connected in parallel. The B+ voltage, which is contemplated as being a simple 9-volt battery, is applied as indicated to comparator 75 and DC/AC inverter 67, as well as to trigger control circuit 64.

In operation, assuming storage capacitor 62 is fully charged, when on/off switch 114 is closed a positive voltage is applied to gate 108 of SCR 104 causing the SCR to immediately conduct causing the entire voltage on the storage capacitor to be applied across flash lamp 103, resulting in a bright flash of extremely short duration. This conduction is substantially instantaneous and the circuit then senses, through feedback loop 73 and circuit 74, that the voltage is a lower than desired full-charge level and will immediately trigger oscillator 65 into operation to recharge the capacitor. When the capacitor reaches the desired full charge, typically 450 volts, the feedback network 74 and comparator 75 sense that the desired voltage has been reached and disable the oscillator, thereby saving battery power. Due to leakage over a period of time, the charge on capacitor 62 may be reduced somewhat. This circuit can be adjusted to detect as little as four to six volts decrease in the charge in capacitor 62 and again through comparator 75 actuate oscillator 65 to bring the charge up to its full desired value.

As indicated previously, there are some flash lamp devices which turn the charging circuit off when the storage capacitor is fully charged. Many of these systems allow the charge on the storage capacitor to be reduced by twenty to twenty-five volts before recharging occurs, due to several possible factors inherent in their circuitry. Because of the precision, simplicity and efficiency of the components and the circuits of the present invention, a charge reduction of four to six volts will be detected by the feedback network and comparator, resulting in recharging the storage capacitor. Frequent, small increment charging uses very little energy, much less than larger amounts of charging which occur less often. Another advantage of the present system is that the charge on the storage capacitor is always up to or near peak so there is no danger that the flash tube would be actuated at a low point, as much as five percent below peak, which could result in less than the desired brightness of flash.

Basically, the prior art devices having an intended similar function are typically much less precise than the present invention and some of them are very temperature sensitive so that the feedback voltage necessary to actuate the charging oscillator could vary greatly with temperature. This is especially true for those devices which depend on the leakage characteristics of a transistor to terminate the charging function. The feedback network and comparator of the present invention are extremely precise and efficient so that very little energy is used while at the same time the charge on the storage capacitor is maintained at the desired level with an extremely low variation. The switching technology used in this invention is very efficient and precise compared with linear technology or flyback transformers previously used.

With specific reference now to FIG. 10 there is shown a schematic of a circuit constructed in accordance with the principals of FIGS. 8 and 9, where this particular circuit is designed to be used on a toy light sword. The peculiar requirements of such a toy is that the high intensity flash be available for immediate energization upon pulling a trigger or otherwise actuating the circuitry, and that it recharge quickly so that the toy can be repeatedly "fired". Additionally, the circuit of FIG. 10 includes a sound output which is an optional feature.

While the values of the components might differ to a certain extent, there is no substantial difference between the flash circuitry of FIG. 10 and the generalized form of FIG. 9. Storage capacitor 62 is connected across flash lamp 61 which is actuated by trigger circuit 63. The storage capacitor is charged through AC/DC convertor and voltage multiplier circuit 71, the output of which is typically 450 volts DC. Oscillator 65 provides the switching necessary for operation of DC/AC inverter 67, and feedback and comparator circuits 74 and 75, respectively, function as previously described. The waveform out of the oscillator shows a square wave with a duty cycle having a 4:1 ratio. This is typical but is not an absolute requirement. This enables the FET in inverter 67 to conduct 80% of the time, thus providing for very rapid charging of the storage capacitor. The 20% off time provides short periods to allow stored energy in the magnetic field to be transferred to the voltage multiplier. The inverter output would have a similar form but amplified to 100–150 volts.

The power supply 115 is comprised of two batteries 123 and 124 and the positive terminal 125 is connected to the trigger circuit through on/off or enabling switch 126 and trigger switch 127. For operation of the circuit, the on/off switch will be placed in an "on" position to provide charging of storage capacitor 62 by means of the connection from the on/off switch through wire 131 and wire 132 to the top portion of coil 133 in inverter 67.

For the sound circuit, speaker 134 is powered through an audio driver stage comprising two transistors 135 and 136 which are connected to transistor 137. A set of three Schmitt trigger elements 141, 142 and 143 are connected between power supply 115 and noise chip 144, one output of which is connected to the common bases of transistors 135 and 136. The noise chip is a conventional off the shelf item, one example of which is an SN9428. The chip establishes the character of the noise including frequency and other characteristics. The first two Schmitt trigger elements, 141 and 142, function as a monostable one shot multivibrator. The speaker generates the desired noise, powered by the power supply 115 for about one second. The time for the noise is governed by a timer circuit comprised of resistor 145 and capacitor 146 in the multivibrator. The output of Schmitt trigger element 143 is the actual trigger output, applied to the circuit represented by chip 144.

Each time the trigger switch 127 is closed after enabling switch 126 has been closed, flash lamp 61 emits a short, bright flash and speaker 134 emits a burst of sound simultaneously with the flash. After the storage capacitor is charged a DC voltage of about 350 volts exists on line 147 and line 151 has a steady 450 volts applied to it. At the instant of closing trigger switch 127, the voltage from power supply 115 is applied to gate 152 of SCR 153, causing it to conduct and the lamp to flash. At that instant, time $t_o$, the voltage on both of lines 147 and 151 drops to zero, and then builds back quickly asymptotically to the normal values as shown by the associated waveforms. As soon as the flash tube fires, the feedback network and comparator function to commence operation of the oscillator, thereby recharging storage capacitor 62. This is normally accomplished within about one second, whereby the toy is then available for "firing" again with another brilliant flash.

The toy light sword of the present invention provides a simple and enjoyable toy that has significant appeal in the toy market. It is simple and easy to build.

In view of the above description, it is likely that improvements and modifications will occur to those skilled in the art which are within the scope of the accompanying claims.

What is claimed is:

1. A toy light sword comprising:

an elongated, hollow, transparent blade;

a handle connected at one end of said blade;

flash lamp actuating means mounted to said handle;

a DC power source;

enabling switch means for selectively connecting said DC power source to said flash lamp actuating means for energization thereof;

high-intensity flash lamp means in said hollow blade for emitting a burst of high-intensity light when actuated by said flash lamp actuating means, said flash lamp means lighting the full length of said blade for a short duration, said blade appearing as a long, thin, short duration, glowing sword when viewed externally upon actuation of said flash lamp means; and trigger switch means for selectively applying the energy in said flash lamp actuating means to said high-intensity flash lamp means to fire said lamp means;

said flash lamp actuating means comprising:

storage capacitor means connected across said flash lamp means;

means connected to said flash lamp means for triggering said flash lamp means into conduction;

oscillator means coupled to said source of DC power;

a DC/AC inverter connected to the output of said oscillator means;

an AC/DC converter and voltage multiplier connected between said DC/AC inverter and said storage capacitor means;

a feedback network;

comparator means connected between said feedback network and said oscillator; and means for coupling the voltage output from said voltage multiplier to said feedback network, said comparator means actuating said oscillator means when a predetermined reduction in the voltage on said storage capacitor means is detected;

whereby said storage capacitor means is maintained at a desired voltage level sufficient to actuate said flash lamp means as desired.

2. The toy light sword recited in claim 1 wherein said enabling switch means is hand operated and is in said handle of said sword for selectively connecting said DC power source to said flash lamp actuating means.

3. The toy light sword recited in claim 1 and further comprising a light transmitting element positioned on the end of said handle opposite to said blade and lit by the light emanating from said high-intensity flash lamp means.

4. The toy light sword recited in claim 1 and further comprising inertial switch means in said hollow blade that closes upon interruption of movement of said blade to cause said flash lamp actuating means to fire said high intensity flash lamp means.

5. The toy light sword recited in claim 4 wherein said inertial switch means includes a movable, electrical conductor means surrounded by an electrically conductive ring, said conductor means moving to engage said ring and close the circuit for firing said high intensity lamp means.

6. The toy light sword recited in claim 5 wherein said movable electrical conductor means includes a free end with a mass thereon to increase the inertial effect.

7. The toy light sword recited in claim 6 wherein said mass is in the form of a ball.

8. The toy light sword recited in claim 1 and further comprising sound generating means electrically connected to said flash lamp actuating means for emitting a sound when said high intensity flash lamp means is fired.

9. The toy light sword recited in claim 8 wherein said sword further comprises a hand shield, said sound generating means is positioned in said hand shield.

10. The toy light sword recited in claim 1, wherein said blade has a fluorescent coating on the inside thereof.

11. The toy light sword recited in claim 10 wherein said fluorescent coating provides a retained glow after said flash lamp means has been fired.

12. The toy light sword recited in claim 1 wherein said triggering means comprises a trigger circuit connected between said flash lamp and said source of DC power.

13. The toy light sword recited in claim 1 wherein said oscillator operates at about 25 KHz.

14. The toy light sword recited in claim 1 wherein said DC/AC inverter has an AC output amplified 10 to 15 times above the voltage value of said DC power source input.

15. The toy light sword recited in claim 14 wherein said AC/DC converter converts said AC signal to DC and said voltage multiplier amplifies the voltage input to a level of about 450 volts.

16. The toy light sword recited in claim 1 wherein said feedback network comprises a variable resistor adapted to adjust the voltage level at which said comparator triggers said oscillator into oscillation.

17. The toy light sword recited in claim 1 wherein said comparator comprises a Schmitt trigger.

18. The toy light sword recited in claim 1 wherein said DC/AC inverter comprises a field effect transistor (FET), the conduction of which is controlled by the output of said oscillator.

19. The toy light sword recited in claim 18 wherein said DC power is applied to said DC/AC inverter through one end of a coil having a tap intermediate its ends, said FET being connected to said tap, the other end of said coil being connected to said AC/DC converter.

20. The toy light sword recited in claim 1 and further comprising a sound circuit adapted to emit a sound substantially simultaneously with the flash of said flash lamp.

21. The toy light sword recited in claim 1 and further comprising a trigger switch connected between said DC power source and said triggering means.

22. The toy light sword recited in claim 20 wherein said sound circuit comprises a speaker powered by an audio driver.

23. The toy light sword recited in claim 1 wherein the predetermined reduction in the level of the voltage on said storage capacitor is about 1% of the desired level.

24. The toy light sword recited in claim 1, wherein said trigger switch means is hand operated and is in said handle of said sword for selectively applying the energy in said flash lamp actuating means to said flash lamp.

25. The toy light sword recited in claim 1, wherein said flash lamp actuating means comprises a storage capacitor which is charged upon actuating said enabling switch means and is discharged through said flash lamp means upon actuating said trigger switch means.

26. The toy light sword recited in claim 1, wherein said flash lamp means is fired substantially simultaneously upon actuating said trigger switch means.

27. The toy light sword recited in claim 1, wherein said trigger switch means comprises an inertial switch in said hollow blade that closes upon interruption of movement of said blade to cause said flash lamp actuating means to fire said high-intensity flash lamp means.

28. A toy light sword comprising:

an elongated, hollow, transparent blade;

a handle connected at one end of said blade;

flash lamp actuating means mounted to said handle;

a DC power source;

enabling switch means for selectively connecting said DC power source to said flash lamp actuating means for energization thereof;

high-intensity flash lamp means mounted to said toy light sword for selective illumination of said blade, said flash lamp means emitting a burst of high-intensity light when actuated by said flash lamp actuating means; and trigger switch means for selectively applying the energy in said energized flash lamp actuating means to said high intensity flash lamp means to fire said flash lamp means;

said flash lamp actuating means comprising:

storage capacitor means connected across said flash lamp means;

means connected to said flash lamp means for triggering said flash lamp means into conduction;

oscillator means coupled to said source of DC power;

a DC/AC inverter connected to the output of said oscillator means;

an AC/DC converter and voltage multiplier connected between said DC/AC inverter and said storage capacitor means;

a feedback network;

comparator means connected between said feedback network and said oscillator; and means for coupling the voltage output from said voltage multiplier to said feedback network, said comparator means actuating said oscillator means when a predetermined reduction in the voltage on said storage capacitor means is detected;

whereby said storage capacitor means is maintained at a desired voltage level sufficient to actuate said flash lamp means as desired.

* * * * *